US005448643A

United States Patent [19]

Parker

[11] Patent Number: 5,448,643

[45] Date of Patent: Sep. 5, 1995

[54] AUTHENTICATON SYSTEM

[75] Inventor: Carlyle V. Parker, Alexander, Va.

[73] Assignee: The United States of America as represented by the Secretary of the Navy, Washington, D.C.

[21] Appl. No.: 227,675

[22] Filed: Sep. 28, 1962

[51] Int. Cl.[6] ..... H04K 1/00

[52] U.S. Cl. ..... 380/59; 380/33; 342/42; 342/50

[58] Field of Search ..... 343/6.5, 6.8; 342/42, 342/44, 45, 50; 380/33, 34, 59

[56] References Cited

U.S. PATENT DOCUMENTS 3,025,516 3/1962 Bickler ..... 342/45

*Primary Examiner*—Tod R. Swann

*Attorney, Agent, or Firm*—Thomas E. McDonnell; Charles J. Stockstill

[57] ABSTRACT

A system for secure communications between first and second locations where the first location measures the location of the second location. The first location then codes that measured location along with a random reply channel code for communications from the second location to the first location. The first location then transmits the two codes to the second location which decodes the two signals. The second location then measures it's own location and compares it with the received location. The newly measured location is coded and transmitted to the first station on the randomly selected reply channel.

3 Claims, 2 Drawing Sheets

AUTHENTICATON SYSTEM

The invention described herein may be manufactured and used by or for the Government of the United States of America for governmental purposes without the payment of any royalties thereon or therefor.

This invention relates to electronic systems for combined navigation, command, and identification purposes and in particular to systems of such type wherein provision is made for insuring the authenticity of information sources for the system.

The problems of identification of friend or foe (IFF) is by now well known at least in general aspects as a result of experiences in the early years of radar devices. In general the identification problem arose because radar systems themselves were not selective but picked up all targets or objects regardless of whether they were of a friendly or enemy nature. Identification of friendly targets by some means was desirable so that they would not be made the objects of destructive forces and to permit such destructive forces to be concentrated on enemy objects. A far more important aspect of this general identification situation exists however in that control of destructive forces as well as communications in general is now performed by radio, wire link, or some other means operative at a distance from a human element. Not only is security of communications required but of utmost importance is the requirement that commands to release destructive forces be given, received, and utilized in such manner as to make it impossible for spurious control signals to be given either fortuitously or by deliberate enemy action.

With the foregoing needs for security and reliability in identification systems, communication systems and now authentication systems, it is easier to justify the expenditure of considerable effort to obtain complex but reliable circuitry to provide the security requirements for all of the foregoing functions with a single apparatus.

In general the apparatus of the present invention seeks to solve the various foregoing problems and provide for various ramifications and permutations which may be considered desirable or may otherwise evolve in the future.

It is accordingly an object of the present invention to provide for the transmission and reception of commands and information between a surface or airborne control station and many aircraft.

Another object of the present invention is to provide for the transmission and reception of enroute and return-to-base navigational information.

It is another object of the present invention to provide for the transmission of positive identification information by all equipped vehicles.

Another object of the present invention is to provide for transmission and reception of orders and information for aircraft terminal control, that is approach and landing control.

Another object of the present invention is to provide for the transmission and reception of commands and information between guided missiles and control stations.

Another object of the present invention is to shift responsibility for precise location of targets from the IFF system to the detecting radar and to navigation equipment carried by the target itself to avoid difficulties caused by multipath reflections by ground and by air IFF operation.

Other objects, advantages and novel features of the invention will become apparent from the following detailed description of the invention when considered in conjunction with the accompanying drawings wherein.

In accordance with the teachings of the present invention identification and authentication of signal sources is obtained wherein the spatial position of one station is the basis of identification and random selection of channels for response and coding of the position and channel information are employed for authentication. One station knows the position of the second station by radar operated by the first station while the second station knows its position by its own navigational devices.

Figure 1:
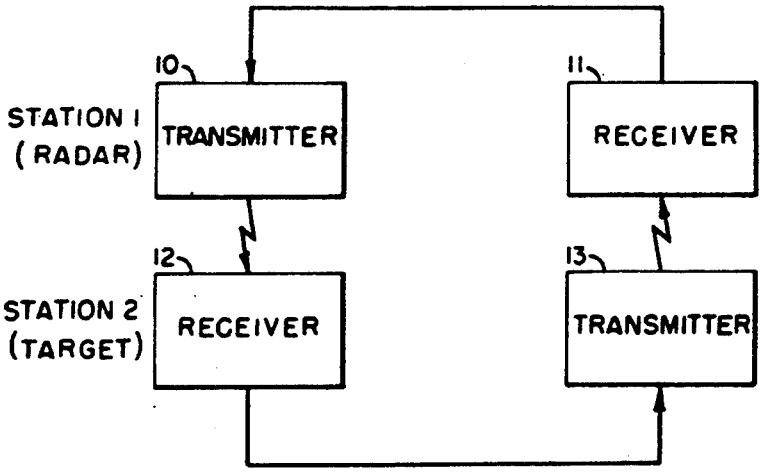
FIG. 1 shows a block diagram of a two source set-up embodying the principles of the present invention.

With reference now to FIG. 1 of the drawing, the apparatus shown therein is intended to indicate in a simplified manner how the basic principles of the present invention may be utilized to accomplish the objects set forth in the foregoing. It is to be emphasized that the showing of FIG. 1 is intended to present the various components in a manner which will enable those skilled in the art to draw upon their knowledge of suitable individual components to produce a workable device. The various components shown are described herein in the simplest form possible to give a reasonable presentation of the particular principles involved without revealing specific circuit details which would bar publication in the forseeable future.

The apparatus of FIG. 1 is shown as four basic components, transmitter 10 and receiver 11 being located at the primary station which is typically that containing the radar device. Station 2 is typically located at the target and contains receiver 12 and transmitter 13, the transmitter 10 being used for transmission to receiver 12 and transmitter 13 being used for transmission to receiver 11. The signal from transmitter 10 to receiver 12 contains a control signal which tells transmitter 13 the proper randomly selected channel to use for reply to receiver 11. In a similar manner, transmitter 13 also selects a random channel and in its message to receiver 11 supplies information to advise transmitter 10 as to the proper channel to use for its reply to station 2. In this way, unless each transmitter replies upon the frequency randomly selected by the other for each portion of the conversation, it is readily possible for one station to detect whether or not it is receiving signals from a friendly station and not some enemy station that is attempting to insert spurious messages without knowing the key to the frequency commands.

In operation transmitter 10 and receiver 11 are at a site containing a radar device which in operation detects the presence of the vehicle or whatever device contains station 2. The transmitter 10 knows its own location and from direction and range information obtained by the operation of its radar system learns the position of the vehicle of station 2 which position has been assigned an "area" number depending upon a previously arranged division of the earth's surface, or space for that matter. Transmitter 10 places this information as to geographical location of station 2 upon each transmission to receiver 12 as a first means of obtaining authentication of signals. The vehicle of station 2 knows its position in terms of area numbers by its own radar or by means of some navigation equipment such as an inertial system or LORAN or TACAN. Thus it is possible for station 2 to determine whether or not station 1 actually knows the position of station 2. If correspondence in area numbers exists, a first requirement for identification of stations is met. Where there are a plurality of station 2's in a given region but in different "areas", it is possible for the proper station 2 to detect that it is being called.

This first requirement is accompanied by other requirements for authentication, one of these being met by the random signals mentioned which tell transmitter 13 the reply frequency to be used. Additionally the coding device changes the signals in some selected manner known only to "friends" and which is changed periodically, say from day to day.

Figure 2:
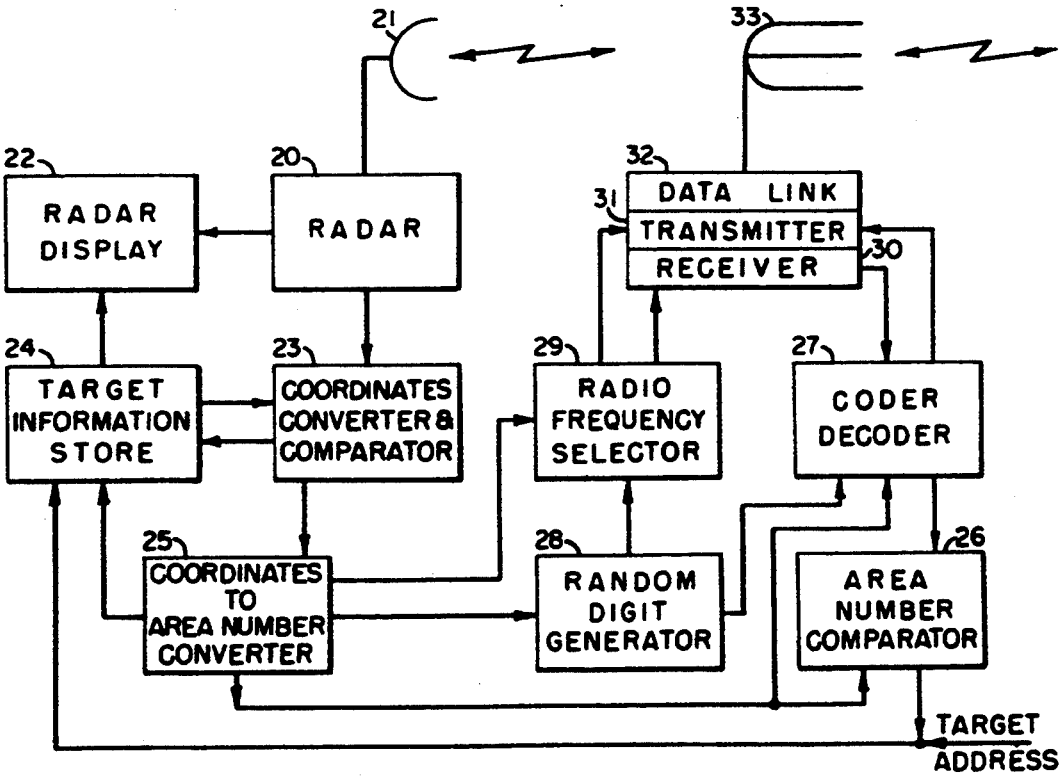
FIG. 2 shows details of the apparatus disposed at the first source location (radar)

To explain the foregoing apparatus and the requirements therefor in greater detail, reference to FIG. 2 which shows the apparatus of transmitter 10 and receiver 11 is now appropriate. The apparatus of FIG. 2 contains a radar system 20 together with its antenna 21 which is normally highly directive and accurately positionable so as to determine the bearing of a distant object. It is of course understood that the antenna could in addition be positionable in elevation so as to determine the elevation of a distant energy reflective object as well as the bearing. The radar system 20 contains conventional time delay measuring apparatus for the determination of range so that it can provide output information regarding the range and bearing of a distant energy reflective object.

The radar system also contains a part here shown separately labeled "radar display" and identified by the reference character 22 which is a conventional form of radar display device such as a PPI providing an indication of the position of energy reflective objects in range and bearing. The radar display device 22 is shown separate from the radar system 20 here to emphasize that radar signals are stored and such stored signals can be displayed on the display.

Range and bearing information as obtained by the radar system 20 is applied to the coordinates converter and comparator of apparatus 23 which converts the range and bearing information by the radar system to XY coordinates of targets relative to station 1 which in general is more convenient. This converter is a device which may include various geometrical arrangements or electronic circuitry such as a contact positionable in bearing and radius over a grid of resistance wires for performing the conversion mentioned.

XY coordinate information obtained from the converter 23 is applied to a storage device 24 which contains at least one storage means such as that disclosed in U.S. Pat. No. 2,656,524 for retaining the target information in its converted form for a selected period of time to enable the overall system to keep a running check on all objects within the range of the radar system so that their positions may be examined from time to time and the presence of new targets detected immediately. The target information storage 24 is connected to the radar display 22 whereby it is possible to view the information stored on the radar display system 22 in addition to the raw radar information. A connection from the target information storage device 24 to the converter 23 is shown whereby new signals to the coordinate converter are compared with old signals.

Connected to the converter and the information storage 24 is a "coordinates to area number converter" 25 which assigns numbers to incoming signals in dependency upon their position in the cooordinates produced by the converter 23. The coordinates to area number converter assigns the appropriate area number to each new target, the area number itself being initially the basis whereby a frequency is assigned for transmission to the target. The coordinates to area number converter is arranged so that the coordinates from the converter 23 are added to or subtracted from the area number of the station 1 to obtain the area numbers of the targets. The conversion can be assisted by an analog to digital converter such as that of U.S. Pat. No. 2,597,866. Whenever a target is detected in a particular area number, the frequency of transmission to that target is automatically assigned by the area number converter so that the target can be challenged as to whether or not it is a friend or a foe or communication with it can be established for other purposes. The basis for this is that presumably the target if it is a friend will have the key to the assignment of area numbers and will know the area number in which it is located. Thus it will have its reception apparatus tuned to the frequency for its area number as a "guard" channel to be capable of receiving an IFF challenge or any other transmission to it which may occur. Thus the result is the effect of a guard channel which changes in accordance with the area number in which the target is located.

The area number converter 25 is connected to the area number comparator 26 and to the coder-decoder 27. Additionally it is connected to the random digit generator 28 and the radio frequency selector 29. The random digit generator 28 is further connected to the radio frequency selector 29 and to the coder-decoder 27. Both the radio frequency selector 29 and the coder-decoder 27 are connected to the transmitter 31 and receiver 30 of data link 32 and in addition the coder-decoder 27 is connected to the area number comparator 26 which in turn is connected to the target information storage 24.

Figure 3:
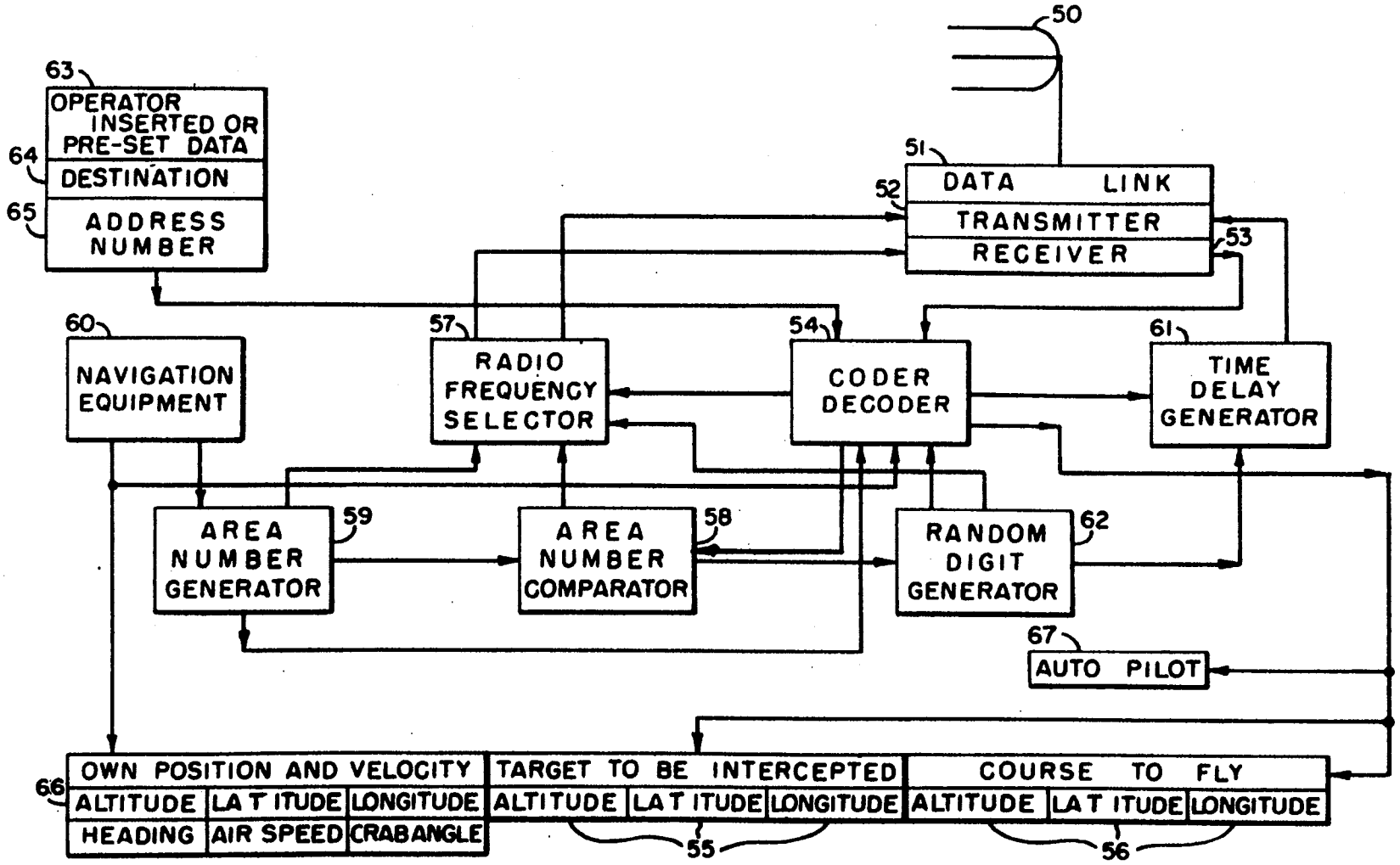
FIG. 3 shows details of apparatus disposed at the second source location (target).

The random digit generator 28 produces a truly random signal preferably in the form of binary digits to be used as the basis for the selection of a radio frequency channel for reply to the apparatus of FIG. 2 by the target (FIG. 3). This random signal goes to the radio frequency selector 29 to control the tuning of the receiver for the reply by the distant target.

It is thus apparent that the apparatus of FIG. 2 thus far described is capable of a substantial amount of security in its operations in that the random digit generator 28 selects the frequency which is to be used by the target station in its reply and that only the target and the radar system of FIG. 2 will know this frequency unless the reception of the signal from the apparatus of FIG. 2 occurs by some unauthorized receiver. A measure of security against such successfully occurring is obtained in the area number itself because the area number coding system is secure to some extent. However it is possible that with the interception of the initial transmission to the distant target by some enemy, he would obtain the random digit information for reply and that he would also have a radar system by which he could determine the area number of the target so that he could at least listen to the conversation if not actually send unauthorized signals to the target or main station in such a way as to initiate some sort of conversation on his own. It thus is apparent that considerably more is required for complete authentication and security. Such is provided by the coder and decoder 27 which adds the area number signal and the random signal typically in sequence and in the form of binary digits and then subjects them to a pseudo-random intermixing of digits or addition of digits or whatever is desired to obtain a resultant signal which must first be decoded before either the area number or the random digit signal can be obtained from it. Thus the coded signal which is a completely scrambled composite of binary digits representing the area number of converter 25 and the random digits of generator 28 is applied to transmitter 31 as the signal to be transmitted by the data link 32 and antenna 33.

The target, if it is a friendly one, will contain apparatus of FIG. 3 appropriate for responding in proper coding to the apparatus of FIG. 2 which response will be received by the antenna 33 and applied to receiver 30. This response will be at the frequency selected by the random digit generator 28 of FIG. 2 in the first instance and will be delivered from receiver 30 to the coder-decoder 27. If the coding and decoding is proper a signal will be applied to the area number comparator 26 wherein it is compared to the target station area number output from converter 25 and if correct for the area number of the target station the comparator will deliver a signal to the target information storage 24. This signal identifies the target as friendly on display 22. Further the decoder 27 extracts the random signal produced by the target station and sends it to transmitter 31 for tuning of transmitter 31 to the randomly selected response channel.

The code employed by the coder-decoder 27 as well as the similar device in the target station is something requiring utmost secrecy and which is changed frequently according to some selected secret schedule. The apparatus of FIG. 3 cooperates with that of FIG. 2 in producing the overall apparatus of FIG. 1. This apparatus of FIG. 3 contains an antenna 50 which is connected to transmitter 52 and receiver 53 which components constitute data link 51. The receiver 53 is connected to the coder-decoder 54 which in turn is connected to the indicators 55 which give command information messages regarding the position of a target to be intercepted and to the indicators 56 which give motion command signals to the vehicle carrying the apparatus of FIG. 3 to achieve a certain condition desired by the apparatus of FIG. 2. The coder and decoder 54 separates the various signals and delivers them to several other components. One of these is the radio frequency selector 57 at which point the random signal produced by the random digit generator of FIG. 2 controls the radio frequency selector 57 to cause the transmitter 52 to reply to the apparatus of FIG. 2 at the frequency selected at random by the random digit generator of FIG. 2. In addition an output of the coder-decoder 54 is applied to the area number comparator 58 which itself is also connected to the area number generator 59 for comparison of the area number signal transmitted by FIG. 2 with the area number signal obtained locally through the area number generator 59 as a result of its connection to the navigation equipment 60 of the apparatus of FIG. 3. Thus the apparatus of FIG. 3 knows its position in area numbers by the operation of its own navigation equipment 60 so that one of the first things that is performed upon this signal from 54 is comparison of area number. Signals which do not come in with the proper area numbers but which do pass the coder and decoder would thus be rejected. Such would be for example signals from the apparatus of FIG. 2 intended to be received by a second target station like that of FIG. 3 located in a different area number location. The coder-decoder 54 is further connected to a time delay generator 61 which randomly selects a time delay from a hundred or even more possibles which delays the response operation of the transmitter 52 by the selected time delay amount which reduces the statistical probability of garbling or overlapping of replies when a number of aircraft are in nearby areas as in a formation. Thus the time delay generator 61 is connected to transmitter 52 for control of the delay of operation with reference to the time of receipt of signals at antenna 50. The time delay generator 61 since it operates at a random nature is connected to the random digit generator 62 which provides for the random operation required. The random digit generator 62 is similar to the component of a similar name in the apparatus of FIG. 2 and is connected to the coder-decoder 54 and the area number comparator 58 to insert into the message from the coder-decoder 54 delivered through time delay generator 61 to the transmitter 52 a randomly generated number which will advise the apparatus of FIG. 2 as to the new channel to use in the next transmission to the target station of FIG. 3. Thus it is seen that with a random generator operating at each end of the apparatus the frequency of transmission is changed at each end with each particular message to reduce the probability of detection by accidental selection of proper channels by an enemy.

Also connected to the coder-decoder 54 is destination information in the form of a signal input from the components 63, 64 and 65. These components provide a signal to be transmitted which is either a particularly desirable preset signal or it can be a signal or message provided by the operator or the like for transmission. The address number is similar to the area number but is with reference to the area number of the apparatus of FIG. 2 or another apparatus of the type of FIG. 3 with which communication is desired. Thus the proper address number 65 would be inserted corresponding to the area number of some other station with which communication by the apparatus of FIG. 3 is desired. This information is supplied direct to the coder 54 to be combined into the overall signal which upon transmission and receipt will be compared with the locally inserted area number at the distant station in apparatus similar to the instant apparatus 58 as a preliminary step in the initiation of communication between such two stations.

The coder-decoder 54 is also connected directly to the navigation equipment 60 to obtain an information signal directly dependent upon the navigational position rather than being transmitted in the form of area numbers. It is contained in binary digit form compatible with the overall scheme. Such navigational information would be primarily related to the velocity and motion direction of the apparatus of FIG. 3 rather than the actual instantaneous position information which is transmitted through the area number generator 59 to the code-decoder 54.

It is to be observed that the navigation equipment 60 is also connected as would be normal for equipment of this type to an indicator 66 located on the apparatus of FIG. 3 for displaying to an operator at that point information relative to the altitude, heading, latitude, longitude, air speed, crab angle, and the like, of the vehicle containing the apparatus of FIG. 3.

A final structural detail of the apparatus of FIG. 3 is indicated as an autopilot 67 which is connected to the output of the coder-decoder 54 Whereby the vehicle containing the apparatus of FIG. 3 may be directly controlled from a distant source such as that containing the apparatus of FIG. 2 without requiring the intermediate action of a pilot.

The apparatus of FIG. 3 continually generates its area number from the navigation equipment and shifts its receiver frequency accordingly, thus receiving and decoding any signal of the radio frequency corresponding to the area number in which it may be located at any one time. Whenever a signal is so received and compared successfully with the area number contained in the received signals, the transmitter frequency is changed to the frequency determined by the received random digits designating frequency and after a time delay chosen at random as a result of the operation of the time delay generator, an enciphered reply determined by the coder and decoder is made consisting of the address number of the apparatus of FIG. 3, the area number, a group of random digits that determines the radio frequency for reply by the apparatus of FIG. 2 which receives the signal, and additional digits as required containing some message to be transmitted.

When the apparatus of FIG. 2 receives the signal, it is received with the receiver "unblanked" as to time delay so as to accept a long time delay and the message so received is decoded. If the received and locally computed (by apparatus of FIG. 2) area numbers of the apparatus of FIG. 3 agree, the vehicle containing the apparatus of FIG. 3 is labeled as "friendly" on the radar display 22 or some other suitable display and the address number of that vehicle is recorded in the target information storage 24. Also a time position is established in the data link system for this new address and at this established time an enciphered reply is made at the radio frequency determined by the target, the reply consisting of the target address number, the surface station address number, and, a new group of random digits that determine the r.f. channel for reply by the airborne system and additional digits as required containing some message to be transmitted.

The apparatus of FIG. 3 receives and deciphers the message. Reception of its own address number properly coded authenticates the station of FIG. 2. Transmission of the address number of the station of FIG. 2 authenticates the apparatus of FIG. 3 when properly enciphered.

A discussion of the selection of some of the parameters of the complete system may be of assistance in understanding the problems involved. The choice of range of radio frequency to be used is highly important from an equipment standpoint and in conjunction with the system bandwidth is a factor in determining the jamming vulnerability. The bandwidth is determined by the frequency stability of the receivers and transmitters and by the signal characteristics. The signal pulse widths are determined by the speed of transmission necessary for any application although it is not essential that a constant transmission speed or pulse width be used for all transmissions within the system. The initial identification of an address number requires the choice of a random delay previously mentioned to avoid garbling of replies. The maximum acceptable delay in determining the friend or foe category of a target is crucial at this point. For airborne targets a very small delay is tolerable compared with that permitted in the identification of slower moving and possible closer spaced targets such as tanks and ships. In the determination of the size of area numbers it may be well to assume that the radar equipment to be used as well as the navigational equipment carried by the target apparatus of FIG. 3 can both readily locate the position of the target within an area two miles on a side. (This is $\pm 0.3$ degree in bearing for a 200 mile radar). The number of squares $2 \times 2$ miles possible on the surface of a spherical earth of 4,000 mile radius is $4\pi \times (4{,}000)^2/4$ or about 50 million squares, requiring 26 binary digits to assign a distinctive area number to each square. To this 26 digits must be added a sufficient number of random digits to obscure the relationship between transmitted signals and the area number and give the reply frequency, and finally some synchronizing and parity check digits must be added. With all of these digits it is reasonable to select a total of 40 digits. At 200 microseconds between pulses, the time required is 8 milliseconds for the simplest interrogation. The reply should contain the area number, the address number, more random bits for obscuring relationship, plus some of the random bits in the interrogation to avoid certain forms of enemy interference, plus synchronizing and parity check bits for a typical total of 80 bits.

The total round trip time neglecting propagation and electronic processing time is, hence, 24.0 milliseconds or about 25 milliseconds total. If the chance that the reply of one target station overlaps that of another is acceptable at a 1 percent rate, then a maximum delay time of $100 \times 80 \times 200 \times 10^{-6}$ or 1.6 seconds may occur between interrogation and reply. The average delay can be expected to be about half of this or 0.8 seconds. Under these conditions 100 aircraft can be identified in one minute and 20 seconds. This rate is not particularly high and so it is desirable to reduce i t i f possible.

Actually it is unnecessary to wait for a reply from one target station before going on to interrogate another target station, since the coded reply from the first target station contains the information as to which target is replying and where it is located. Hence the 200 microsecond narrow band system can be used satisfactorily with an adequate radar identification, and a low probability of garbling due to either echoes or overlapping of replies is obtained, provided that reception on any one of several reply frequencies is allowed during this period. By suitable choice of the indicated reply frequency, the possibility of garbling is avoided entirely for widely spaced targets. A sufficient number of frequency channels should be always available to make it unlikely that an interrogation will garble with a reply at the same frequency. A typical system which has been used in this particular arrangement employs a total of 1750 channels with a signal to jam ratio advantage of 1750 to 1.

To take account of the fact that a target may lie on or near the boundary between two areas, the "area" size, is more properly chosen as approximately 1/9th the area of uncertainty in position. Hence instead of the four square mile area as previously discussed on the basis of probable error in position location, an area of only about 4/9ths of a square mile is necessary. Choosing an area smaller than this increases the danger that an area number would go unrecognized because of an extreme error in navigation, while a larger area reduces the number of possible areas and hence increases the vulnerability to enemy guessing. If the area size is 1/9th the area of uncertainty in position then 99.73 percent of the measurements of position in a target give coordinates for the target within the area.

Obviously many modifications and variations of the present invention are possible in the light of the above teachings. It is therefore to be understood that within the scope of the appended claims the invention may be practiced otherwise than as specifically described.

What is claimed is:

1. Apparatus for secure communication between first and second locations comprising: means for producing at the first location a signal characteristic of the location of the second source; means for selecting at random a channel for reply by the second source; means, operatively coupled to said means for producing and to said means for selecting, for transmitting the location and channel information to the second source; means at the second source for receiving the transmission; means at the second source, operatively coupled to said means for receiving, for comparing the location of the second source as contained in the received transmission with the actual location of the second source as known at the second source; means at the second source for selecting a reply channel for the first source; and means at the second source, controlled by said means for comparing and operatively coupled to said means at the second source for selecting, for transmitting a signal in the channel selected by the first source and containing the location of the second source and the reply channel selected at the second source.

2. Apparatus for secure communication between first and second locations comprising: means at the first location for determining the position of the second location; means, operatively coupled to said means for determining, for producing at the first location a signal characteristic of the location of the second source as determined by said first named means; means for selecting at random a channel for reply by the second source; means, operatively coupled to said means for producing and to said means for selecting, for transmitting the location and channel information to the second source; means at the second source for receiving the transmission; means at the second source for determining the location of the second source independent of the location determining means at the first source; means at the second source, operatively coupled to said means for receiving and to said means at the second source for determining, for comparing the location of the second source as contained in the received transmission with the actual location of the second source as locally determined; means at the second source for selecting a reply channel for the first source; and means at the second source, controlled by said means for comparing and operatively coupled to said means at the second source for selecting, for transmitting a signal in the channel selected by the first source containing the location of the second source locally determined and the reply channel selected at the second source.

3. Apparatus for secure communication between first and second locations comprising: means at the first location for determining the position of the second location; means, operatively coupled to said means for determining, for producing at the first location a signal characteristic of the location of the second source as determined by said first named means; means for selecting at random a channel for reply by the second source; means, operatively coupled to said means for producing and to said means for selecting, for transmitting the location and channel information to the second source in coded form; means at the second source for receiving and decoding the transmission; means at the second source for determining the location of the secondly source independent of the location determining means at the first source; means at the second source, operatively coupled to said means for receiving and decoding and to said means at the second source for determining, for comparing the location of the second source as contained in the received transmission with the actual location of the second source as locally determined; means at the second source for selecting a reply channel for the first source; and means at the second source, controlled by said means for comparing and operatively coupled to said means at the second source for selecting, for transmitting in coded form, corresponding to the same code used by the first location, a signal in the channel selected by the first source containing the location of the second source locally determined and the reply channel selected at the second source.

* * * * *

UNITED STATES PATENT AND TRADEMARK OFFICE

CERTIFICATE OF CORRECTION

PATENT NO. : 5,448,643

DATED : September 5, 1995

INVENTOR(S) : Carlyle V. Parker

EST AVAILABLE COPY

It is certified that error appears in the above-identified patent and that said Letters Patent is hereby corrected as shown below:

Title page, Item 54, Line 1, change "AUTHENTICATON" to

—AUTHENTICATION—.

Signed and Sealed this

Fourteenth Day of November, 1995

*Attest:*

*Attesting Officer*

BRUCE LEHMAN

*Commissioner of Patents and Trademarks*